US008417387B2

(12) United States Patent
Neto et al.

(10) Patent No.: US 8,417,387 B2
(45) Date of Patent: Apr. 9, 2013

(54) CONTROL SYSTEM AND METHOD FOR OPERATING A COOLING SYSTEM

(75) Inventors: Luiz Magalhaes Medeiros Neto, Joinville (BR); Douglas Pereira da Silva, Joinville (BR)

(73) Assignee: Whirlpool S.A., Sao Paulo-SP (BR)

( * ) Notice: Subject to any disclaimer, the term of this patent is extended or adjusted under 35 U.S.C. 154(b) by 0 days.

(21) Appl. No.: 12/302,312

(22) PCT Filed: Jun. 1, 2007

(86) PCT No.: PCT/BR2007/000134

§ 371 (c)(1),
(2), (4) Date: Mar. 27, 2009

(87) PCT Pub. No.: WO2007/137382

PCT Pub. Date: Dec. 6, 2007

(65) Prior Publication Data

US 2009/0187286 A1 Jul. 23, 2009

(30) Foreign Application Priority Data

Jun. 1, 2006 (BR) ..... 0601967

(51) Int. Cl.
*G01M 1/38* (2006.01)

(52) U.S. Cl. ..... 700/276; 700/299; 700/301

(58) Field of Classification Search ..... 700/276, 700/282, 299, 301; 62/126, 157, 498
See application file for complete search history.

(56) References Cited

U.S. PATENT DOCUMENTS

| | | | | |
|---|---|---|---|---|
| 3,491,546 | A | 1/1970 | Holzer | |
| 4,439,997 | A | 4/1984 | Cantley | |
| 5,673,565 | A | 10/1997 | Jeong et al. | |
| 2004/0050084 | A1 | 3/2004 | Fukumi et al. | |
| 2004/0187502 | A1 * | 9/2004 | Jayanth et al. | 62/126 |
| 2004/0231339 | A1 * | 11/2004 | Miozza et al. | 62/3.2 |
| 2006/0075771 | A1 | 4/2006 | Tracey, Jr. et al. | |
| 2006/0090482 | A1 | 5/2006 | Dawes | |

FOREIGN PATENT DOCUMENTS

| | | |
|---|---|---|
| WO | WO 97/17578 | 5/1997 |
| WO | WO 2006/034718 | 4/2006 |

OTHER PUBLICATIONS

The International Search Report for PCT Application No. PCT/BR2007/000134; Filed Jun. 1, 2007; Date of Completion Oct. 29, 2007; Date of Mailing Nov. 7, 2007.
The Written Opinion for PCT Application No. PCT/BR2007/000134; Filed Jun. 1, 2007; Date of Completion Oct. 29, 2007; Date of Mailing Nov. 7, 2007.
Response to Written Opinion Dated Apr. 1, 2008.
The International Preliminary Examination Report for PCT Application No. PCT/BR2007/000134; Filed Jun. 1, 2007; Date of Submission of Demand Apr. 1, 2008, Date of Completion of Report Aug. 11, 2008.

* cited by examiner

*Primary Examiner* — Mohammad Ali
*Assistant Examiner* — Nathan Laughlin
(74) *Attorney, Agent, or Firm* — Alston & Bird LLP

(57) ABSTRACT

The present invention relates to a control system for operating a cooling system comprising components at least including a compressor (2), an evaporator (3), a pressure control element (6) and a condenser (4), and also having a control circuit (9) having electrical connections with at least some cooling system components, through which the control circuit (9) continually measures and stores, over time intervals, electrical operating variables of the cooling system, the control circuit establishes interrelationships among at least some measured values and some stored values of the electrical operating variables of the cooling system and generates a control signal for the cooling system based on at least some measured values and stored values of the electrical operating variables and on the interrelationships established among at least some measured and stored values of the electrical operating variables of the cooling system.

21 Claims, 6 Drawing Sheets

CONTROL SYSTEM AND METHOD FOR OPERATING A COOLING SYSTEM

FIELD OF THE INVENTION

The present invention relates to an electronic control system for operating cooling systems of the kind used in the conservation of food and beverages, or for air conditioners.

BACKGROUND OF THE INVENTION

Cooling systems such as refrigerators, freezers, air conditioners and others, are used to cool environments and/or to freeze different kinds of products for consumption. These devices usually remain connected for long periods of time and consume large quantities of energy. Therefore, nowadays it is an ongoing concern for manufacturers of this kind of equipment to develop mechanisms that reduce energy consumption as much as possible whilst at the same time maintaining cooling efficiency.

All cooling equipments comprise a cooling circuit whose function is to maintain the low temperature inside the cooled space. This cooling circuit is a closed circuit, through which a cooling fluid circulates, and is essentially comprised of a hermetic compressor, a condenser, a pressure control device and an evaporator. When the cooling fluid in liquid state passes through the evaporator, it absorbs heat from the environment to be cooled, and transforms itself into vapor. Next, the fluid in vapor state originating from the evaporator is sent to the compressor, whose function is to compress the fluid and cause it to circulate in the circuit. Afterwards, the heated fluid in vapor form passes through the condenser, where it is converted into liquid state, releasing heat to the external environment. Next, the fluid circulates towards the pressure control device, where it undergoes a drop in pressure. The function of this device is to control the pressure of the cooling fluid to be sent to the evaporator. This cooling cycle repeats continually for as long as the cooling equipment is running.

Besides the basic components described above, cooling systems usually also have ventilators mounted near the evaporator and the condenser, cooling flow control valves, air flow control dampers and lamps mounted inside and outside the cooled space.

Cooling systems also include a control system for controlling the operations of some of the cooling system components. The purpose of this control system is to guarantee that the temperature inside the cooled space is kept at the desired values, even when variations occur in the external conditions of the cooler, for example, an increase in room temperature or, in the case of refrigerators or freezers, frequent door openings of the appliance causing the temperature of the cooled space to rise.

Manufacturers of cooling systems have constantly sought to develop improvements in control systems so that they maintain the temperature conditions inside the cooled space and, at the same time, provide improved conditions of use for the different cooling system components. Said conditions include operations with lower energy consumption, and working conditions that do not cause wear and tear of the component parts, providing increased durability of the equipment.

The control systems currently applied to cooling systems use a central processing unit that receives signals from the cooling system sensors, such as thermopars, thermistors, current sensors, door-opening sensors, movement sensors, etc. The function of these sensors is to detect the working conditions of the cooling system components and/or general characteristics of the cooled space and the external environment. Therefore, each sensor is installed in the different environments where it is desirable to control the conditions, or else is attached directly to the cooling system components themselves. For instance, pressure and temperature sensors are installed in the evaporator, condenser and flow control device in order to measure the pressure and temperature inside these equipments.

Based on the values measured by these and other sensors, the operation of the cooling system is controlled. The signals originating from the sensors, corresponding to physical and electrical variables, are processed by the central processing unit, which interprets the parameter variation detected by each sensor in isolation. Next, the central processing unit generates control signals for each component of the cooling system, solely based on the relative parameter values from each cooling system component in isolation.

Based on this control architecture of the cooling system, the control of the working conditions of each cooling system component is performed solely based on the measurement of the physical and electrical variables that are directly related to the operation of this same component. No broader evaluation is made on the general operation of the cooling system, in order to identify the interdependency existing in the operation of the system components. In other words, the control is carried out on a local and individual basis, not on a more all-embracing or integrated basis, searching to optimize the operation of all components simultaneously.

Additionally, this kind of control system requires the use of at least one sensor to detect the working conditions of each cooling system component. Consequently, this kind of circuit has the disadvantage of being rather complex, in view of the number of connections and wiring required for installment, and it is also costly due to the need for a large quantity of sensors and because of the various assembly steps applied in the production lines of cooler appliances.

An example of a temperature control system of a cooling or heating appliance from the state of the art based on the use of sensors, designed to reduce the consumption of energy of the appliance, is described in document U.S. Pat. No. 6,745,581. According to this North-American patent, the system is designed for drink dispensers wherein the temperature at the point of consumption needs to be quite low, in the case of cooled drinks, or quite high in the case of hot drinks. This control system comprises sensors designed to detect the conditions on the outside of the appliance, such as movement sensors for persons in the proximity of the cooling appliance and door-opening sensors that are connected to a central processing unit which controls the operation of the appliance. The conditions detected and recorded by the control system are related to activities around the appliance that are indicative of the use thereof. Consequently, the control system learns functional patterns (standards) associated to the schedules of use of the appliance, and establishes a low energy consumption program over a specific time period based on the functional patterns learned. The control system is able to control the cooling system to start lowering the temperature of the cooled space with the required antecedence for products inside it to reach the temperature most suitable for consumption at the point in which consumption movement begins.

This temperature control system is solely intended for cooling appliances that have no need to maintain a constantly low temperature in the cooled space, required to conserve food products. Therefore, during times when there is no consumption of the products stored in the appliance, the temperature in the cooled space can be kept higher in order to reduce energy consumption.

Additionally, the control system according to this patent application requires the use of sensors designed to read physical variables outside the cooler, such as door-opening sensors, movement sensors, vibration detectors and others. Detecting movement and learning the patterns of use of the appliance cannot be based on measurements of electrical variables related to the cooling system components themselves.

Nor does this control system carry out an integrated control over the operation of the cooling system components. Controlling the cooling system is solely based on activity conditions from outside the cooling appliance.

PURPOSES OF THE INVENTION

Thus one purpose of this present invention is to provide a cooling system having a robust and economical control system, comprising simple architecture, and that at the same time has a differentiating factor in relation to control circuits already known.

Another purpose of the invention is to provide a control system that controls the operation of the cooling systems in an integrated manner, so that the operational control of each component of the cooling system is carried out based on an evaluation of the joint operation of other system components.

A further purpose of the invention is to provide a control system for a cooling system that dispenses with or considerably reduces the use of sensors designed to detect the working status of each of the cooling system components and that monitors and controls all these components by way of a single circuit.

Another purpose of the invention is to provide a control system for a cooling system that monitors the operation of the cooling system components by way of electrical signals from the components themselves.

Yet another purpose of the invention is to provide a control system for a cooling system that can detect working errors of specific cooling system components and take preventive measures against malfunctions, in order to provide increased durability for said components.

BRIEF DESCRIPTION OF THE INVENTION

The purposes of the invention are achieved by way of a control system for operating a cooling system comprising components at least including a compressor, an evaporator, a pressure control element and a condenser, and also having a control circuit having electrical connections with at least some cooling system components, through which the control circuit continually measures and stores, over time intervals, electrical operating variables of the cooling system. The control circuit establishes interrelationships among at least some measured values and some stored values of the electrical operating variables of the cooling system and generates a control signal for the cooling system based on at least some measured values and stored values of the electrical operating variables and on the interrelationships established among at least some measured and stored values of the electrical operating variables of the cooling system.

According to the invention, the control system may comprise a record of a standard functional profile of the cooling system that has values of functional physical variables of the cooling system, values of electrical operating variables of the cooling system and interrelationships among values of physical variables and values of electrical variables. The control circuit performs comparisons and interrelationships among the values of electrical operating variables of the cooling system that are measured and stored, and the values of functional physical variables and the values of electrical operating variables recorded in the standard functional profile of the cooling system. The control circuit generates the control signal for the cooling system based on the comparisons and interrelationships established among the values of electrical operating variables of the cooling system that are measured and stored and the values of functional physical variables and the values of the electrical operating variables recorded in the standard functional profile of the cooling system. The standard functional profile of the cooling system can be updated based on the functional physical variables and on the electrical operating variables of the cooling system that are measured and stored over a set period of time.

Alternatively, the control system according to the invention may be applied to a cooling system that also comprises supplementary elements chosen from the group essentially comprising: ventilator, heating resistors, cooling fluid flow control valve, air flow control regulator, lamp inside the cooled space and lamp outside the cooled space. The control circuit has electrical connections with at least some supplementary elements of the cooling system, through which the control circuit continually measures and stores, over time intervals, electrical operating variables of the cooling system.

In another alternative embodiment of the control system of the invention, the control circuit measures and stores functional physical variables of the cooling system, establishes interrelationships among the measured and stored values of the functional physical variables and of the electrical operating variables and generates the control signal also based on the physical operating variables of the cooling system and its interrelationships. The functional physical variables of the cooling system are chosen from the group essentially comprising: outside environmental temperature, temperature of the cooled space, pressure and temperature of the cooling fluid. The control system also comprises sensors that read at least some of the functional physical variables of the cooling system.

Alternatively, the control circuit of the control system according to the invention stores the control signal generated for the cooling system continually over time intervals.

The control system according to the invention may also comprise user-interfacing means for the adjustment of the functional parameters of the cooling control system, and that display the functional status and the measured values of the cooling system variables.

The purposes of the invention are also achieved by means of a method of controlling the operation of a cooling system that comprises components at least including a compressor, an evaporator, a pressure control element and a condenser, and that also has a control circuit, the method comprising the following steps:

measuring electrical operating variables of at least some of the cooling system components, continually over time intervals, by means of an electrical connection between the control circuit and at least some of the cooling system components;

storing the measured values of the electrical operating variables of the cooling system;

establishing interrelationships among at least some of the measured and stored values of the electrical operating variables of the cooling system; and generating a control signal for the cooling system based on at least some measured and stored values of the electrical operating variables and on the interrelationships established among at least some measured values and stored values of the electrical operating variables of the cooling system.

Alternatively, the control method according to the invention may also comprise the step of establishing a standard functional profile of the cooling system comprising values of functional physical variables of the cooling system, values of electrical operating variables of the cooling system and interrelationships among values of physical variables and values of electrical variables and the step of making comparisons and interrelationships among the measured and stored values of electrical operating variables of the cooling system and values of functional physical variables and values of electrical operating variables of the standard functional profile of the cooling system.

The control method according to the invention may also comprise the step of measuring and storing functional physical variables of the cooling system, establishing interrelationships among the measured and stored values of the functional physical variables and the measured and stored values of electrical operating variables and generating the control signal of the cooling system also based on the measured and stored values of functional physical variables of the cooling system and its interrelationships.

The step of measuring and storing functional physical variables of the cooling system comprises sensor measurements and storage of variables chosen from the group essentially comprising: external environmental temperature, temperature of the cooled space, pressure and temperature of the cooling fluid.

Additionally, the control method according to the invention may also comprise a step of storing the control signal generated for the cooling system continually over time intervals.

The control method according to the invention may also comprise the step of identifying malfunctioning of at least one of the cooling system components by interpreting the measured and stored values of electrical operating variables of the cooling system and the step of updating the standard functional profile of the cooling system.

Additionally, the method according to the present invention alternatively comprises, in the step of measuring the electrical operating variables, the step of reading and storing continually over time intervals electrical operating variables of at least some supplementary elements of the cooling system chosen from the group essentially comprising: ventilator, heating resistors, cooling fluid flow control valve, air flow control regulator, lamp inside the cooled space and lamp outside the cooled space, by means of an electrical connection between the control circuit and those of at least some supplementary elements of the cooling system.

The purposes of the invention are also achieved by means of a method of controlling the operation of a cooling system especially intended for application in a control system for operating a cooling system of the type disclosed in this present invention.

BRIEF DESCRIPTION OF THE DRAWINGS

The present invention will now be described in greater detail based on the drawings. The drawings show.

DETAILED DESCRIPTION OF THE DRAWINGS

Figure 1:
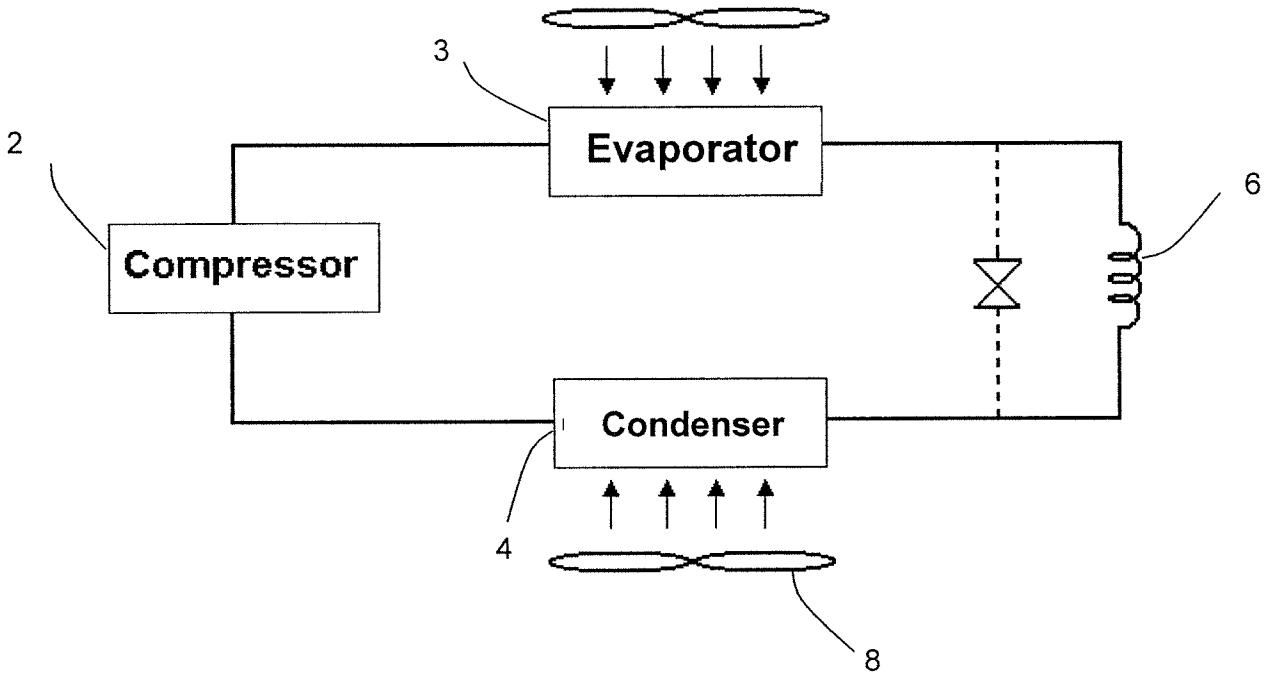
FIG. 1—a schematic diagram of an embodiment of a cooling system that is operated by the control system according to the present invention.
Figure 2:
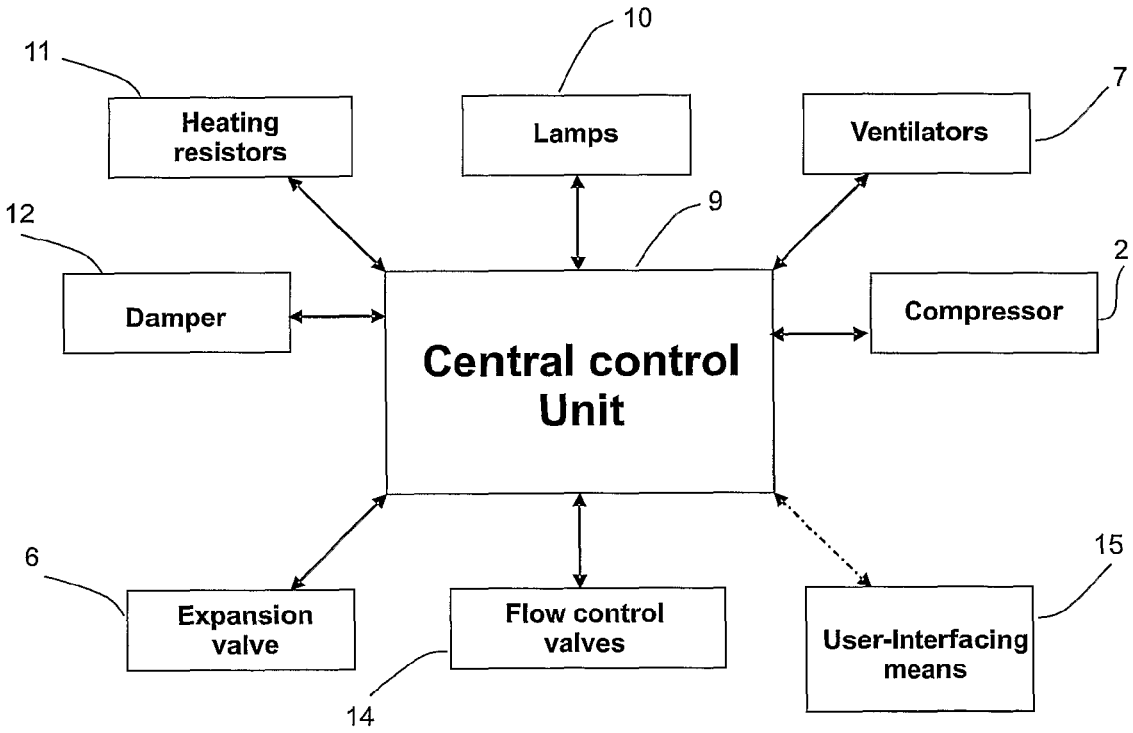
FIG. 2—a schematic diagram of an embodiment of the control system according to the present invention.

The control system according to the present invention may be applied to the operation of a cooling system of the kind illustrated in FIG. 1. Essential elements of the cooling system 1 according to the invention comprise at least a compressor 2, an evaporator 3, a condenser 4 and a pressure control element 6, which may be a capillary tube or an expansion valve. These essential components are part of the cooling circuit itself, through which the cooling fluid circulates. Besides these essential components, the cooling system 1 may also comprise supplementary cooling elements, which are schematically illustrated in FIG. 2. These supplementary elements are contained in, but are not limited to the group essentially comprising: ventilators 7 for the evaporator and compressor, heating resistors 11, cooling fluid flow control valve 14, air flow control regulator, also referred to as dampers 12, lamp inside the cooled space and lamp outside the cooled space 10.

The cooling system also has a control circuit that is electrically connected to the components and supplementary elements of the cooling system that emit or receive some kind of electrical signal. The function of the control circuit is to control the working and operation of all parts of the cooling system.

FIG. 2 presents a schematic illustration of a preferred embodiment of the control system according to the present invention. As can be seen in FIG. 2, the system has a central control unit 9 that is electrically connected to the essential components and supplementary elements of the cooling system that emit and/or receive some kind of electrical signal. In the preferred embodiment of the invention illustrated in FIG. 2, the control unit 9 is electrically connected to the compressor 2, ventilators of the evaporator and of the condenser 7, lamps 10, heating resistors 11, expansion valve 6, damper 12, flow control valve 14 and any user-interfacing device 15. This electrical connection between the central control unit 9 and the cooling system parts can be made directly by way of a connecting wire, or else by way of other electrical circuit elements or combinations thereof, such as resistors, inductors, capacitors, or similar elements that are able to transmit the electrical signal or electrical quantities from the input or output of the cooling system parts to the central control unit input 9.

By way of this electrical connection between the control unit 9 and the cooling circuit parts, the control unit reads electrical operating variables of the cooling system components. The measurements may be performed continually over set time intervals, or may be taken during the time period in which the cooling system is switched on.

The electrical operating variables are measured without the need to use specific sensors for such, since due to their electrical nature, they can be measured directly by the control unit 9. These variables represent direct or indirect operating conditions to which each part of the cooling system is subject and that depend on the conditions dictated by external factors, such as environmental temperature, voltage and power frequency.

Measurements of the electrical operating variables taken from the compressor 2 of the cooling system 1 include the input current, power, power voltage, power factor and ohmic resistance. Measurements of these electrical variables enable other variables dependent thereon to be determined by simple calculation, such as the angular component or the engine torque of the compressor and the work cycle ratio of the compressor, which is the ratio between its on and off times.

With regard to the evaporator 3 and the condenser 4, the variations of the physical factors noted, such as pressure and temperature of the cooling fluid, can be read indirectly by the control unit by reading the electrical variables of other components, such as a input current, power consumed, and electric engine torque of the compressor and alterations in other elements of the system, such as the ohmic resistance of the condenser ventilator.

If an expansion valve of the solenoid-valve type is applied, this valve may be electrically connected to the control unit which will be able to measure the electrical operating variables of voltage applied to the valve as well as the signal period.

Examples of electrical operating variables that can be measured from the ventilators 7 of the cooling system 1 are the current, power, power voltage, power factor and ohmic resistance. Quantities such as the torque and work cycle ratio of the ventilator may also be calculated based on the values of these variables.

The central control unit 9 is also able to measure the frequency and amplitude of the control signal and work cycle ratio of the flow control valve 14, among others.

Additionally, the unit can also measure the current, power, power voltage and electrical resistance of the heating resistors 11 or any other resistors used in the cooling system.

Besides the previously described electrical variables relating to the various components and supplementary elements of the cooling system, the central control unit is also capable of measuring any other variables of an electrical nature of other system components or elements that dispense with the use of sensors for gauging the value.

The control circuit of the cooling system is also capable of storing the values of the electrical operating variables of the components and the supplementary elements of the cooling system that were measured during the set time periods. In preferred embodiments of the invention, storing these values may be carried out by way of a database generated in the control unit itself, or by way of an auxiliary memory device attached to the control unit 9.

Additionally, the control unit 9 is capable of processing the information relating to the electrical variables measured and stored thereby, so as to establish interrelationships among the behavior of at least some of these electrical operating variables corresponding to the different parts which make up the cooling system. Therefore, the control unit 9 is capable of establishing and learning functional patterns of the cooling system by historically analyzing the behavior of the electrical operating variables of its parts and inter-relating the behavior of the electrical variables of certain parts that have an operating dependency relationship between them.

Usually both in the functional patterns learned and in the standard profile of the control system, for a given thermal load and external condition (environmental temperature, power voltage and frequency . . . ), typical values are established for the electrical and/or physical variables that are acquired by the central processing unit. Changes in the operating conditions of the components and/or in the external conditions cause changes in these variables and provide feedback for the historic record stored in the central unit, which, in turn, furnishes control signals for the system components, establishing a new operating condition. Therefore, once the values of the electrical operating variables of the components and supplementary elements of the cooling system are stored, this control unit 9 is capable of monitoring the variations of these values and, consequently, produces and learns countless functional patterns establishing interrelationships among the operation of the various components and supplementary elements of the cooling system.

Accordingly, when the control unit 9 generates the control signals of the cooling system, it can take into consideration both information relating to system's behavioral patterns produced thereby, and the values themselves measured at the current moment and at prior moments of various parts of the cooling system.

Figure 6:
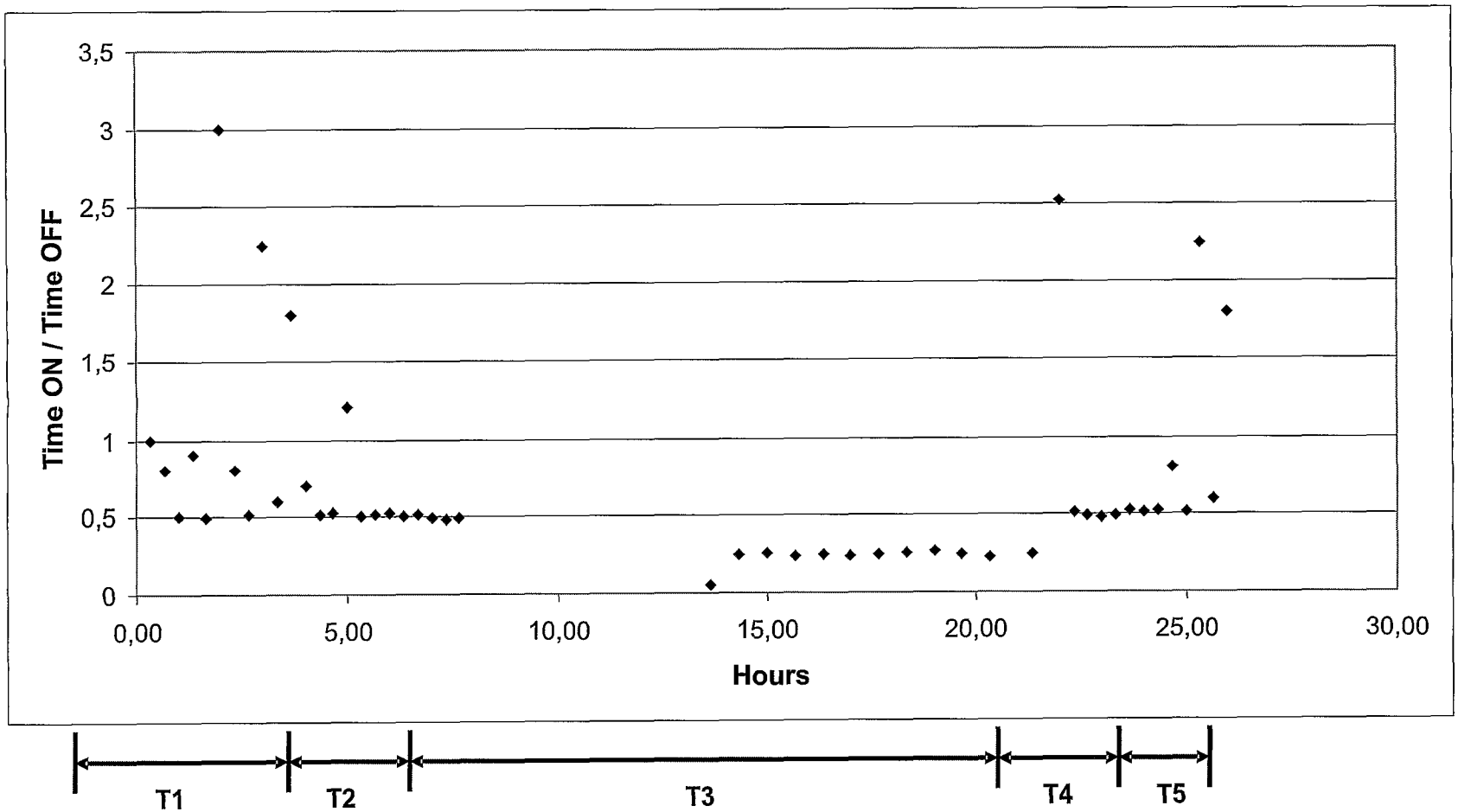
FIG. 6—a diagram representing the ratio between the on and off times of the compressor of a cooling system controlled by a control system according to the invention.

FIG. 6 shows the behavior of the ratio between the ON/OFF times of the compressor (2) controlled by a control system according to the present invention. This figure illustrates an example of learning a functional pattern of the cooling system and subsequent application of the pattern learned in similar working conditions.

In the first time interval T1 illustrated in FIG. 6, the cooling system is functioning and undergoing external interventions. As of the second time interval T2, there are no more external interventions in the cooling system and the Time ON/Time OFF ratio remains constant.

Based on the knowledge of the recent and prior historic records of the operation of the cooling system, the control system alters the temperature setpoint parameter of the cooled space, increasing it in order to save energy. Until the temperature reaches the new setpoint, the compressor remains switched off, as shown at the beginning of the third time interval T3. Once the temperature setpoint is reached, the compressor is switched on and a new Time ON/Time OFF ratio is produced, having a very low value. From then onwards, the compressor operates with a lower 'on' time and a greater 'off' time, resulting in a lower value for the Time ON/Time OFF ratio and with longer cooling cycles.

In the fourth time interval T4, based on the prior working knowledge of the cooling system, the control lowers the temperature setpoint to cool the internal space. This initially produces a greater 'on' time and a low 'off' time in the first cycle T4, producing a high value for the Time ON/Time OFF ratio. Next, in this fourth time interval T4, the compressor reverts to the profile of the second time interval T2. In the fifth time interval T5, external interventions begin again in the cooling system, being represented, as in the first time interval T5, by the large oscillation of the Time ON/Time OFF ratio of the compressor.

An example of application of the system according to the present invention that is designed both to save energy and to improve the cooling process refers to the control of the degree of ventilation of the condenser 4 and/or of the evaporator 3 by monitoring the current and the power voltage of the compressor 2. An increase in the thermal load of the cooling system is reflected in the increase in evaporation pressure inside the evaporator 3, which, in turn, is reflected in an increase of the condensation pressure inside the condenser 4. Consequently, there is an increase in the power current of the compressor 2 and in the power consumed thereby, since higher pressures in the evaporator 3 and in the condenser 4 requires greater electric engine torque of the compressor 2. Based on this increase in the current of the compressor 2 and also by monitoring the input voltage of same, it can be effectively identified whether the power consumed by the cooling system increased or whether the increase in the current was due to a drop in voltage, which happens in induction engines. If there is an increase in the input current of the compressor together with a proportional drop in the power voltage, then there has been no increase in power consumed, because the voltage produced by the current has been constant. If, on the other hand, there has only been an increase in the input current of the compressor, without a considerable reduction in its input voltage, this indicates that there has been an increase in the power consumed.

If there is an increase in the input power of the compressor 2, it can be deduced that the thermal load of the system increased. Thus, the control unit 9 learns that the variation of the input current of the compressor 2, when its voltage remains constant, and the variation of pressure of the evaporator 3 and the condenser 4 occur in an inter-related manner and thus establishes a functional standard for the cooling system relating to the variation of its thermal load.

In this situation, the control unit 9 can emit a control signal to increase the speed of the ventilator 7 of the evaporator and/or of the condenser, whenever possible, or drive a supplementary ventilator, if such exists, to improve the cooling condition. If an expansion valve is used as a pressure control element 6, the control signal may also adjust the aperture of this valve to the pressure conditions of the evaporator 3 and the condenser 4. The inverse control of these devices would also be possible with a view to lowering the energy consumption, if a reduction in the cooling system's thermal load is detected.

The architecture of the control system according to the present invention enables the detection of malfunction in any of the cooling system parts, in the event that the control unit 9 perceives that the behavior of a given electric variable related to a part over a set period of time is not in accordance with a known functional standard or with the behavior of other inter-related electrical variables relating to other cooling system parts.

When a defect or malfunction in a part is detected, the system according to the invention is able, for example, to shut down the compressor, as a preventive measure to avoid greater damages to the cooling system, or display a message in an interfacing device warning the user of the malfunction of said part.

Figure 4:
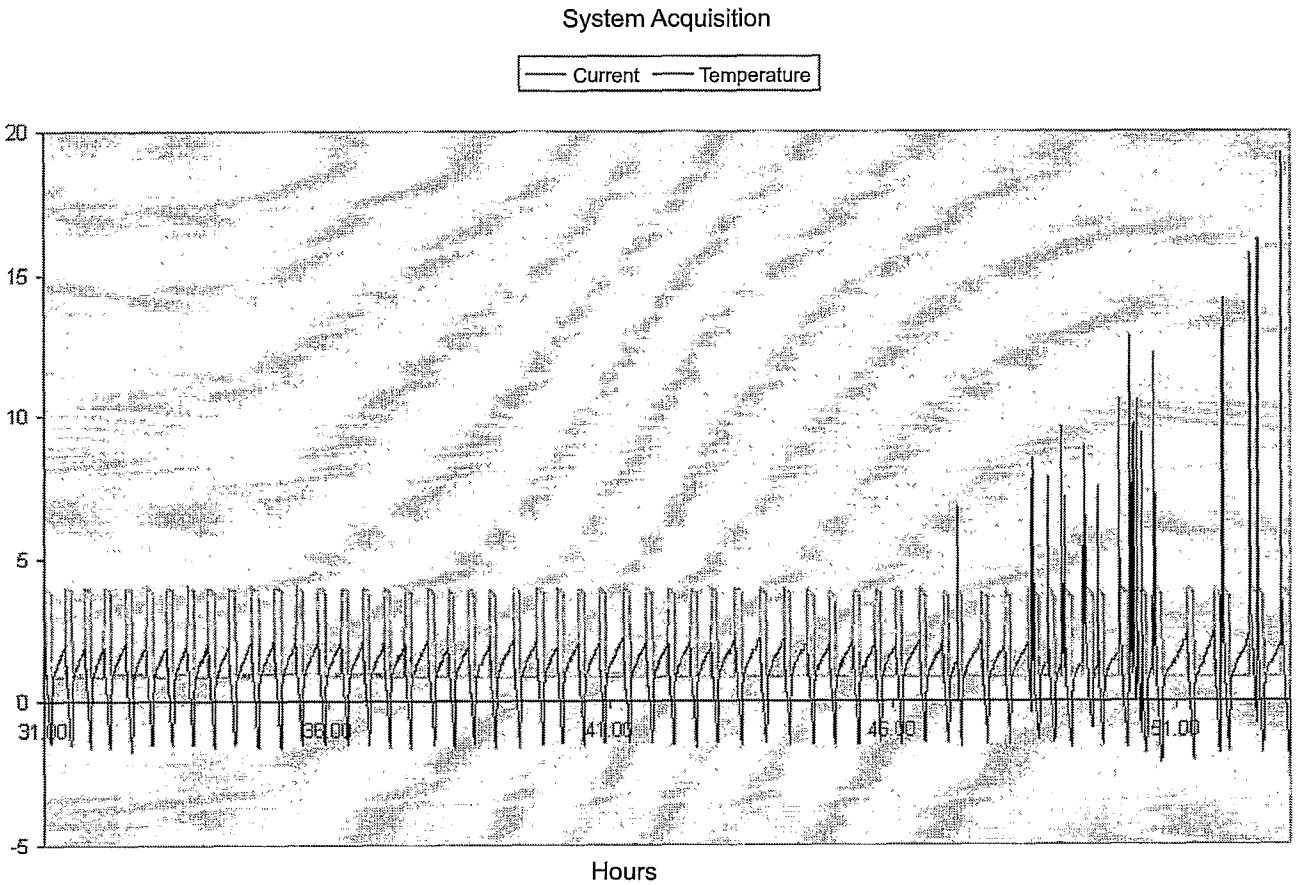
FIG. 4—a diagram representing an example of a behavior of the current of the compressor associated to the variation of the inner temperature of the cooled space in a cooling system according to the state of the art.
Figure 5:
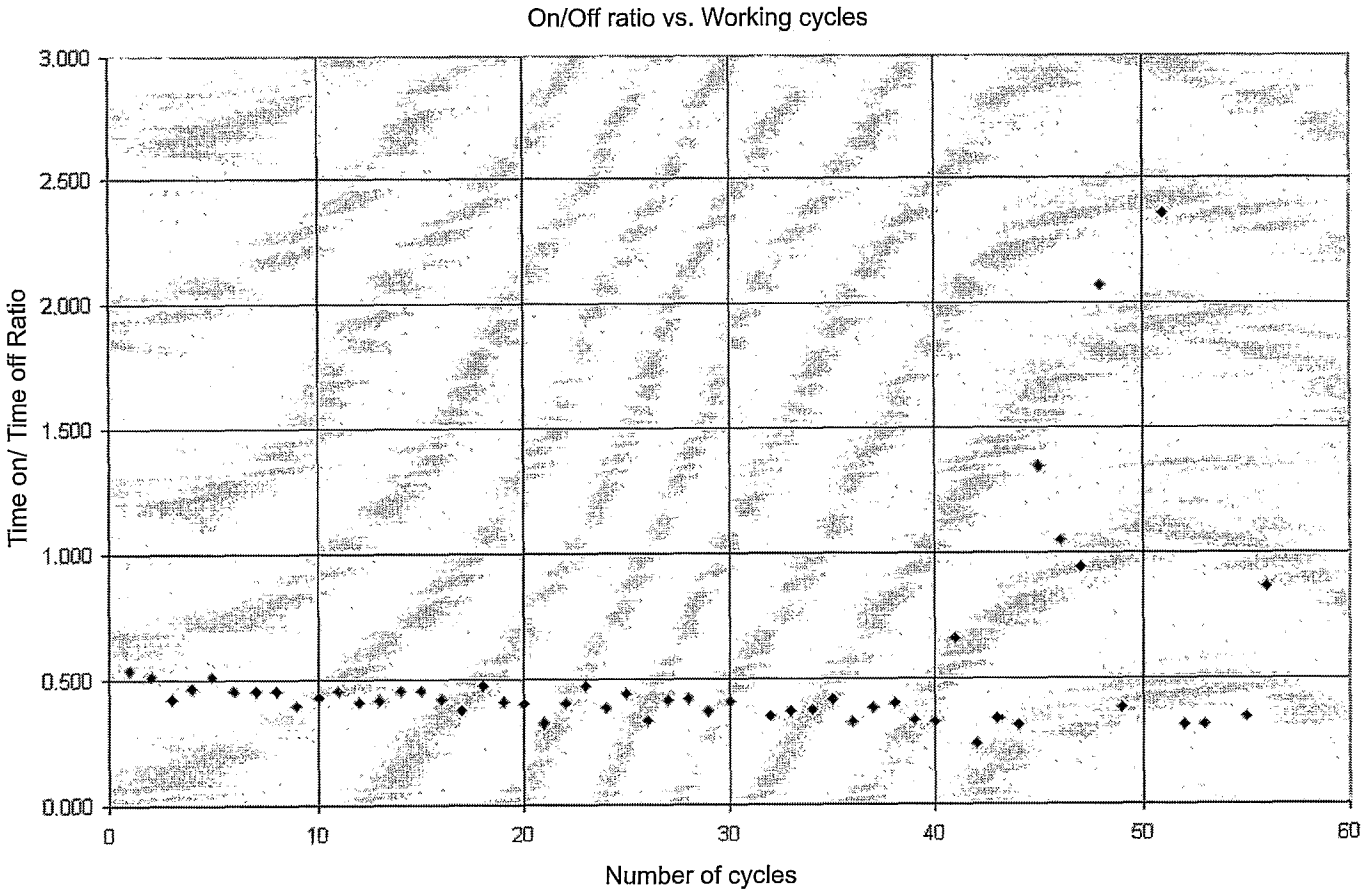
FIG. 5—a diagram representing the ratio between the on and off times of the compressor of a cooling system controlled by a control system according to the state of the art, in a time period equivalent to that used in FIG. 4.

FIG. 4 shows the behavior of the current of the compressor associated to the variation in temperature inside the cooled space, over a time interval of approximately 60 cycles. FIG. 5 shows the ratio between the on/off times of the compressor 2 in a period of time equivalent to the one used in FIG. 4 to measure the current of the compressor 2, in order to establish a comparative analysis between these variables.

As can be seen in FIG. 5, initially, up to approximately 46 cycles, the ratio between the on/off times of the compressor 2 is practically constant, or shows minor variations. This initial period of time represents a situation in which no variation occurred in the operating conditions of the system components or in the external conditions, given that the temperature of the cooled space also remains constant. In a second moment subsequent to the 46 cycles, in the diagram of FIG. 5, a variation of the ratio between the on/off time of the compressor 2 is noted, characterizing the occurrence of a variation in the functional status of the cooling system components. An increase in the temperature of the cooled space and a change in behavior of the current signal of the compressor are also noted, as illustrated in FIG. 4. Based on the comparison between the initially observed value, the current value and the stored historic value, the system is able to define a control signal that can search for an operating regimen that seeks to optimize energy consumption of the cooler. The control unit 9 is also able to establish interrelationships or comparisons with already known behavioral patterns, which can be used to diagnose an abnormal operating condition.

An example of application of the control system according to the present invention in this sense consists of monitoring the degree of blockage of the condenser in cooling systems used in commercial applications. An example of a condenser consists of a series of metal sheets having various alettes through which the air circulates. Usually, the condenser is mounted on the outside of the cooling appliance, being exposed to dust and other environmental impurities which accumulate in its alettes and block the air flow of the condenser, impairing its functional efficiency.

When a continuous current is applied to the coil of a ventilator engine when said engine is switched off, for example, soon after the end of the period in which the compressor was working, it is possible to deduce the ohmic resistance of ventilator 7. The ohmic resistance is a variable proportional to the temperature of the equipment. Thus, by reading the ohmic resistance, the temperature of the ventilator 7 can be deduced. In these systems, the ventilator is positioned very near to the condenser 4 and within a niche designed to accommodate other system elements. When the condenser 4 is blocked, two factors occur. The dissipation of heat from the ventilator 7 is impaired because the airflow generated thereby is prejudiced, since the airflow originating from the condenser is reduced. At the same time, the temperature of the niche increases. By monitoring the historical records of the resistance of the ventilator, it can be noted whether it would tend to increase in temperature or whether any increases are merely due to load variations. If the increase in the ohmic resistance is merely temporary, this indicates that this change is due to the variation of the load only during the set time interval. On the other hand, when there is a progressive trend of increase in this ohmic resistance, and when it remains at a high value for a long period of time, then the control unit recognizes that the condenser is being blocked. The control unit is then able to identify a situation wherein the condenser blockage begins to become critical for the performance of the system and activates an alarm or even generates a control signal to reverse the situation.

As can be seen from the prior examples, establishing interrelationships among behaviors of electrical variables associated to different parts of the cooling system enables the working of all parts to be monitored jointly in an integrated manner, by way of a single central control unit 9, thus dispensing with the need to use various sensors that evaluate the operation of each cooling system part separately and in isolation. Accordingly, the control circuit that centralizes the function of controlling the cooling system is able to identify the influence that the functional change of a certain cooling system part will have on the working of the other parts. The operational dependency relationship of the cooling system parts allows its operation to be controlled solely, or at least essentially, based on the joint behavioral pattern of its parts and by way of monitoring its electrical operating variables.

In another preferred embodiment of the invention, the central control unit 9 of the cooling system comprises a record of a standard functional profile of the cooling circuit. This standard functional profile has values of functional physical variables of the cooling system, values of electrical operating variables of the cooling system and interrelationships among the values of physical variables and the values of electrical variables.

The electrical variables of the cooling system contained in the standard functional profile correspond to the same electrical variables mentioned previously that can be read by the control unit 9 based on the cooling system parts, such as power current, power voltage, power factor, among others.

The functional physical variables of the cooling system correspond to physical values that generally cannot be measured by common electrical signals. Examples of functional physical variables generally applicable to cooling systems and normally comprised in the functional profile are the external environment temperature, the temperature of the cooled space and the pressure and the temperature of the cooling fluid at various points of the cooling circuit.

The standard functional profile recorded in the central control unit 9 can, for example, be previously established, when the control system is manufactured, based on data already known to the manufacturer relating to the operation of cooling system parts and the behavior of these variables. Thus, when the cooling system becomes operational for the first time, this standard profile is already recorded in the control unit.

In another possible embodiment of the invention, the control unit 9 has no standard functional profile record, or only has data relating to functional physical variables, when the cooling system becomes operational for the first time. In this case, the functional profile will be generated based on the first measurements of the variables over a set period of time.

The standard functional profile of the cooling system may also be updated based on data from any variables measured and stored by the cooling system over time. This updating process may be carried out voluntarily by the user, or automatically by the control system itself, for example, when the system notes a fundamental change in the operation of the system that requires such updating.

In cases where the control system according to the invention has a standard functional profile, the control unit 9 is able to perform comparisons and interrelationships among the behavior of cooling system variables measured and stored over a period of time and the values of functional physical variables and of electrical operating variables of the standard functional profile record of the cooling circuit. The results of these comparisons and interrelationships can then be used by the central control unit 9 in the generation of control signal of the cooling system parts.

In another preferred embodiment of the control system according to the invention, the control unit 9 also measures and stores, over a period of time while the cooling system is operating, functional physical variables of the cooling system, such as the external environment temperature, the temperature of the cooled space, the pressure and the temperature of the cooling fluid at various points of the cooling circuit. This data is normally read by way of certain sensors attached to the control system, such as thermopars, thermistors and pressure sensors.

The central control unit 9 is able to establish interrelationships among the values measured and stored of the functional physical variables and of the electrical operating variables over set time periods, and to use this information to generate the control signal of the cooling system parts.

The measured values of the functional physical variables can also be used by the central control unit 9 to generate a standard functional profile, or to establish and learn the functional standards of the cooling system.

The control circuit may alternatively store the control signal generated for the cooling system components continually over time intervals, also to establish interrelationships among the behavior of electrical operating variables and functional physical variables and the control signal generated in each situation. These stored control signal data and their interrelationships with the behavior of the cooling system variables may be used in the generation of future control signals.

In another preferred embodiment of the invention, the control system also comprises a user-interfacing device 15. This device may be a regular or touch-sensitive screen, or associated to a keyboard, or a system of sound or light warning alarms, or any other kind of user-interfacing device.

This device 15 may be used by the user to adjust certain functional parameters of the cooling control system, such as temperature of the cooled space, operating times of the cooling system, or to control an automatic icer or chilled water dispenser, or any other mechanisms available in the cooling system.

Additionally, the interfacing means may optionally display the working conditions of the cooling system parts that are being monitored by the control unit 9, displaying, for example, the measured values of both the physical and electrical variables of the cooling system. The interfacing device may also be capable of warning the user of a malfunction of any part of the cooling system detected by the control system, or simply warn him that there is some kind of error in the system.

The present invention also refers to a method of controlling a cooling system whose components at least comprise a compressor 2, an evaporator 3, a pressure control element 6 and a condenser 4, and that also has a control circuit that essentially comprises a central control unit 9. The method according to the invention may alternatively be applied to a cooling system that also comprises, besides these components, supplementary cooling elements that are contained in, but not limited to the group essentially comprising: ventilators 7, heating resistors 11, cooling fluid flow control valve 14, air flow control regulator 12, lamp inside the cooled space, lamp outside the cooled space 10.

Figure 3:
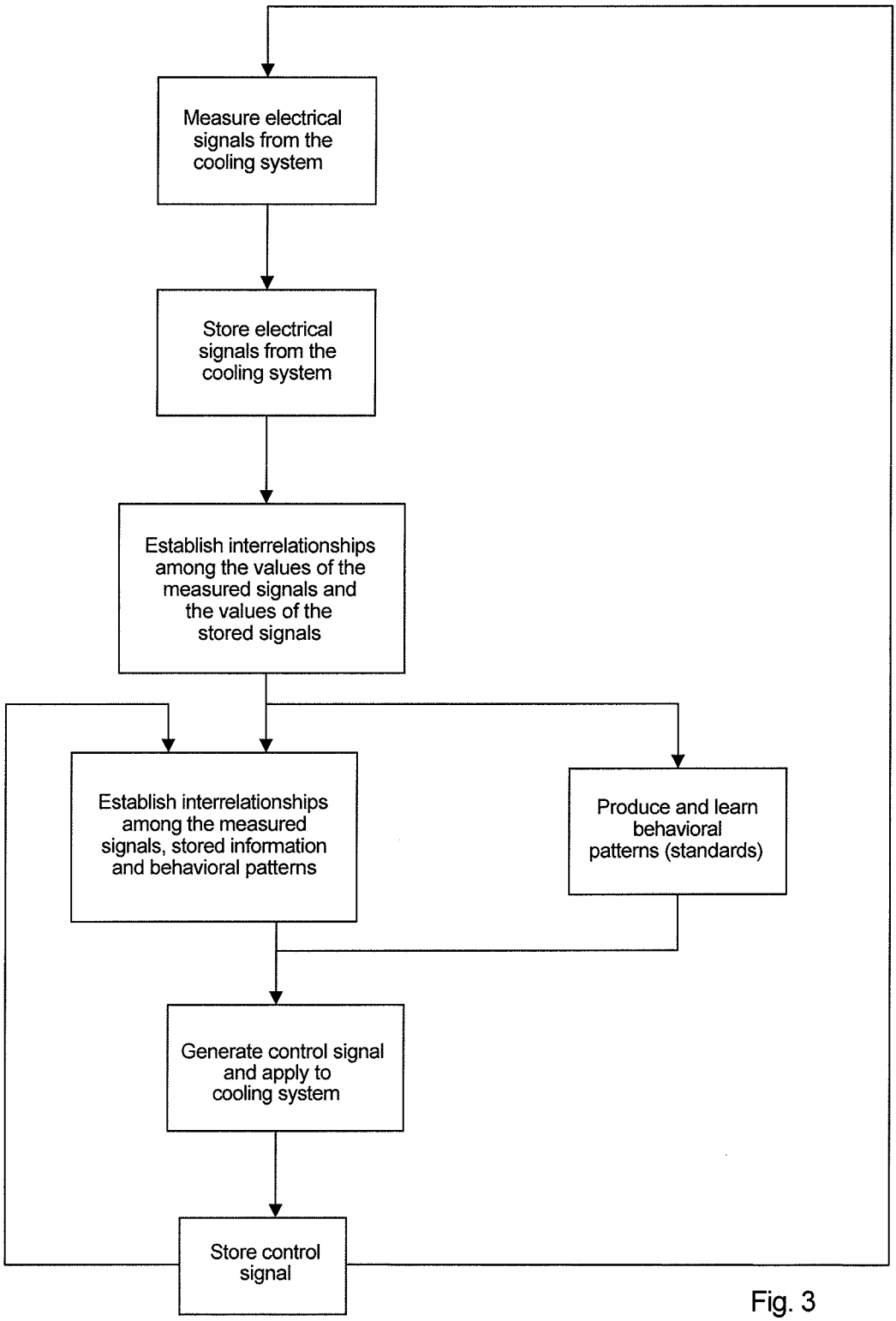
FIG. 3—a flow chart of an embodiment of the control method according to the present invention.

A schematic diagram of an embodiment of the method according to the invention is illustrated in FIG. 3. The method according to the invention comprises a first step of reading the electrical operating variables of the cooling system components, continually over time intervals. The measurement of the electrical variables is performed by means of an electrical connection between a central control unit 9 and the components and any supplementary elements of the cooling system that emit and/or receive some kind of electric signal. This electrical connection between the central control unit 9 and the cooling system components can be carried out directly by means of a connecting wire, or by way of other electrical circuit elements or combinations thereof, such as resistors, inductors, capacitors, or similar elements that are able to transmit an electrical signal or electrical quantities from the input or output of the cooling system parts to central control unit 9 input connections. In other words, the measurement is made directly without the help of sensors.

The method also comprises a step of storing the measured values of the electrical operating variables of the cooling system components, generating a database. Generally, storage can be made directly in the central control unit 9, but it is also possible for these variables to be stored in other memory devices attached to the control unit 9. The storage step can be carried out over the whole operating period of the cooling system, or during set periods of time only. The database containing the values of any variables measured by the control system can be updated or deleted.

The method according to the invention also has a step of establishing interrelationships among at least some measured and stored values of the electrical operating variables of at least some of the cooling system components. These interrelationships may be established among values relating to a same variable, or between values related to variables originating from a same cooling system part, or between variables related to different parts of the cooling system measured at any moment.

Additionally, the method according to the invention provides for a step of generating a control signal for the cooling system based on at least some measured and stored values of the operational variables of at least some of the cooling system components and on the interrelationships established among these variables. In other words, the control unit 9 processes and interprets information relating to variables of various cooling system parts both measured at the current moment as well as those relating to prior moments, in order to identify interrelationships among the behavior of these variables. Accordingly, the control system is able to produce and learn functional patterns of the cooling system, in which the increase in value of a certain variable necessarily causes an increase or reduction in proportion to the value of the other system variables.

Thus, by monitoring, for example, a certain electric variable of a cooling system component, the control system immediately recognizes a change in the working conditions of the cooling system, and also knows beforehand what other changes will be needed in the operation of at least some of the other cooling system parts, in order for the system to adapt to the new working conditions. Accordingly, the control system adjusts the control signal so that the cooling system may function suitably.

Consequently, in the method according to the present invention, controlling the cooling system is carried out in a more optimized way, since the changes in the operating form of the cooling system parts are made before there are sudden alterations to the operation of the cooling system. In other words, the operation of the cooling system is adapted to the system's new working conditions, before these new conditions cause an impact upon its operations. This allows parts of the cooling system to last longer, because the method according to the invention prevents them from being subject to wear and tear resulting from these sudden changes in the working conditions of the cooler.

Additionally, the control method according to the invention is able to provide a reduction in energy required by the cooling system, since this method allows the cooling system to operate more suitably to the working conditions of each moment.

The control method according to the invention may alternatively comprise the step of establishing a standard functional profile of the cooling circuit. This profile comprises values of functional physical variables and values of electrical operating variables of the cooling system of the kind mentioned previously, as well as the interrelationships among the values of physical variables and the values of electrical variables. This step of establishing the standard profile may occur, for example, at the start of the working period of the cooling system, in which the electrical variables or other variables measured by the control system in this period are stored and processed by the control unit 9, in order to generate a standard profile. Alternatively, the profile may be generated or updated at any time the cooling system is running by will and at the command of the user, or automatically by the control system. It is also possible to generate this profile prior to the start of operations of the cooling system based on information already known to the manufacturer.

In preferred embodiments of the invention, the control method may also comprise a step of performing comparisons and interrelationships among measured and stored values of electrical operating variables of the cooling system and the information contained in the standard functional profile. This step is designed to enable the central control unit 9 to test whether the cooling system parts are functioning in accordance with the standard profile, or within another known functional standard. Further, the control unit 9 is able to identify the physical conditions the cooling system is operating under, since the standard profile contains data relating to variables of physical and electrical conditions of the cooling system's operations.

Thus, the data resulting from the comparisons and interrelationships of the values of the variables measured and stored with the standard profile information can be used by the control unit 9 in the control signal generation step.

The control method according to the invention may also comprise steps of measuring and storing functional physical variables of the cooling system, such as the temperature of the external environmental and the cooled space, the frequency with which the door is opened or cooling fluid pressure. Normally, these procedures are carried out with the assistance of sensors. The control method can then establish interrelationships among the measured and stored values of the functional physical variables and the measured and stored values of electrical operating variables. Thus, the control unit 9 can generate the control signal of the cooling system components also based on the measured and stored values physical operating variables of the cooling circuit and its interrelationships.

The physical operating variables may also be used when defining the initial functional profile of the cooling system, and also the functional patterns learned by the cooling system.

In a possible embodiment of the invention, the control method also has a step of storing the control signal generated for the cooling system components continually over time intervals. This stored signal may also be used when future control signals are generated for the various cooling system parts. The control unit 9 is able to establish interrelationships among the control signal and the behavior of certain physical or electrical variables of the cooling system, or functional patterns already known to the system.

Since the control system knows various functional patterns of the cooling system learned over time, or based on the information from the standard functional profile recorded in the control unit 9, then the method according to the invention may also comprise a step of identifying a malfunctioning in the cooling system components. This identification is carried out by interpreting the behavior of electrical variables measured by the control unit 9 and a comparison thereof with other stored values of electrical operating variables of the cooling system, or with functional patterns already known to the control system.

In another alternative method according to the invention, a constant standard functional profile can be adopted during a set period of time, which is applied after establishing that the cooling cycles have stabilized. In this case, the temperature control setpoint is adjusted after establishing that the ratio between 'on' working period divided by the 'off' working period has become constant within a certain variation range. Normal functional status can be restored, for example, due to a change in the ratio between on/off times of the compressor 2 and/or by opening the door of the cooling system.

An example of application of the method according to the present invention lies in the learning of use patterns and use schedules of the cooling system from reading the on/off times of the compressor during the cooling cycles. From a measurement of the input current of the compressor, the time periods in which it is on or off can be directly determined. FIG. 4 shows a variation of the input current of the compressor together with the variation of the temperature inside the cooler over a time period of 60 cycles, and FIG. 5 illustrates how the time ON/time OFF ratio varies during this same time interval, which is, in this figure, divided into cooling cycles. In this sense, the current of the compressor represents the ON/OFF times themselves, the variations of which can be measured over time.

From this time ON/time OFF ratio, it is possible to determine whether or not the cooler is being used. If this ratio falls while the temperature of the cooled space is kept constant, this indicates that the cooling appliance is not being used or is being used with a very reduced frequency during that time period. The control system is able to establish a correlation of this time ON/time OFF ratio with a temporal basis of the control unit, which can be an internal time basis, such as the control unit clock, or a common watch as may be associated to a calendar. Thus, the control system can learn the time periods where there is greater or lesser use of the cooling system and the control system can draw up its own calendar.

Having learned this use pattern, while the cooling system is not being used, the control unit 9 can generate control signals designed to save energy for the system as a whole such as, for example, shutting down internal lamps. When the cooling system is used to cool elements that do not require that temperatures be kept very low during the period in which the cooler is not being used, then the control system can increase the temperature of the cooled space or adopt thaw strategies to adapt to this environment. Through monitoring the electrical variables of the compressor that indicate the use of the cooling system, it is possible to determine the working times of a business establishment where the cooling system is installed. This way, it is possible to guarantee that the cooling system will operate in energy-saving mode when the establishment is closed. At the same time, during working times of the business establishment, the control system guarantees that all the elements of the cooling system that were deactivated or modified for energy-saving purposes be activated and working within the defined standards without requiring user intervention.

Therefore, according to the present invention, the task of learning the working schedule is performed without the assistance of sensors designed to detect the use based on factors outside the cooling system, such as sensors that detect human activity in the vicinity of the cooler. On the contrary, learning the working schedule of the business establishment according to the present invention is carried out solely based on monitoring the behavior of electrical variables of the cooling system itself.

Having described examples of preferred embodiments, it must be understood that the scope of this present invention encompasses other possible variations, and is only limited by the content of the claims, including possible equivalents.

The invention claimed is:

1. A control system for operating a cooling system comprising as components at least a compressor, an evaporator, a pressure control element and a condenser, the control system comprising:

a control unit separate from said cooling system components, the control unit comprising a control circuit through which electrical signals for a plurality of said cooling system components pass, each of the plurality of cooling system components being sensorless, the control circuit controlling operation of the plurality of cooling system components via said electrical signals, said electrical signals being directly or indirectly indicative of operating conditions to which each of the plurality of cooling system components is subject and which depend on factors external to each of the plurality of cooling system components, the control circuit being configured to continually measure and store, over time intervals, electrical operating variables of the plurality of cooling system components, wherein values of the electrical operating variables are measured within the control circuit based on said electrical signals of the plurality of cooling system components passing through the control circuit, the control circuit being further configured to establish interrelationships among at least some measured and stored values of the electrical operating variables of the cooling system components and generate a control signal for the cooling system based on at least some measured and stored values of the electrical operating variables and on the interrelationships established among at least some measured and stored values of the electrical operating variables of the cooling system components.

2. The control system, according to claim 1, characterized in that the control circuit comprises a record of a standard functional profile of the cooling system that has values of functional physical variables of the cooling system, values of electrical operating variables of the cooling system and interrelationships among the values of physical variables and the values of electrical operating variables.

3. The control system, according to claim 2, characterized in that the control circuit performs comparisons and interrelationships among the values of electrical operating variables of the cooling system measured and stored, and the values of functional physical variables and the values of electrical operating variables of the standard functional profile record of the cooling system.

4. The control system, according to claim 3, characterized in that the control circuit generates the control signal for the cooling system based on the comparisons and interrelationships established among the values of electrical operating variables of the cooling system measured and stored and the values of functional physical variables and the values of electrical operating variables of the standard functional profile record of the cooling system.

5. The control system, according to claim 1, characterized in that the cooling system also comprises supplementary elements chosen from the group consisting of a ventilator, heating resistors, a cooling fluid flow control valve, an air flow control regulator, a lamp inside the cooled space and a lamp outside the cooled space.

6. The control system, according to claim 5, characterized in that the control circuit has electrical connections with at least some supplementary elements of the cooling system, through which the control circuit continually measures and stores, over time intervals, electrical operating variables of the cooling system.

7. The control system, according to claim 1, characterized in that the control circuit measures and stores functional physical variables of the cooling system, establishes interrelationships among the measured and stored values of the functional physical variables and of the electrical operating variables and generates the control signal also based on the physical operating variables of the cooling system and their interrelationships.

8. The control system, according to claim 7, characterized in that the functional physical variables of the cooling system are chosen from the group consisting of external environment temperature, temperature of the cooled space, pressure and temperature of the cooling fluid.

9. The control system, according to claim 1, characterized in that the control circuit stores the control signal generated for the cooling system continually over time intervals.

10. The control system, according to claim 1, characterized by also comprising user-interfacing means for adjusting the functional parameters of the cooling control system.

11. The control system, according to claim 10, characterized in that the user-interfacing means display the working conditions and the measured values of the cooling system variables.

12. The control system, according to claim 2, characterized in that the standard functional profile of the cooling system can be updated based on the functional physical variables and on the electrical operating variables of the cooling system measured and stored over a set time interval.

13. A control method for operating a cooling system that comprises as components at least one compressor, an evaporator, a pressure control element and a condenser, and that also has a control unit separate from the cooling system components, the control unit comprising a control circuit through which electrical signals for a plurality of said cooling systems components pass, each of the plurality of cooling system components being sensorless, the control circuit controlling operation of the plurality of cooling system components via said electrical signals, said electrical signals being indicative of operating conditions to which each of the plurality of cooling system components is subject and which depend on factors external to each of the plurality of cooling system components, the method comprising the following steps:

measuring, within the control circuit, values of electrical operating variables of the plurality of the cooling system components, continually over time intervals, based on said electrical signals of the plurality of cooling system components passing through the control circuit;

storing the measured values of the electrical operating variables of the cooling system components;

establishing interrelationships among at least some of the measured and stored values of the electrical operating variables of the cooling system components; and generating a control signal for the cooling system based on at least some measured and stored values of the electrical operating variables and on the interrelationships established among at least some measured values and stored values of electrical operating variables of the cooling system components.

14. The control method, according to claim 13, further comprising a step of establishing a standard functional profile of the cooling system comprising values of functional physical variables of the cooling system, values of electrical operating variables of the cooling system components, and interrelationships among the values of physical variables and the values of electrical operating variables.

15. The control method, according to claim 14, characterized by also comprising a step of performing comparisons and interrelationships among measured and stored values of electrical operating variables of the cooling system and values of functional physical variables and values of electrical operating variables of the standard functional profile of the cooling system.

16. The control method, according to claim 13, further comprising the steps of reading and storing functional physical variables of the cooling system, establishing interrelationships among the measured and stored values of the functional physical variables and the measured and stored values of electrical operating variables and generating the control signal of the cooling system also based on the measured and stored values of the functional physical variables of the cooling system and their interrelationships.

17. The control method, according to claim 13, further comprising a step of storing the control signal generated for the cooling system continually over time intervals.

18. The control method, according to claim 13, further comprising a step of identifying a malfunction of at least one of the cooling system components by interpreting the measured and stored values of electrical operating variables of the cooling system components.

19. The control method according to claim 13, comprising a step of updating the standard functional profile of the cooling system.

20. The control method according to claim 13, wherein the step of measuring electrical operating variables also comprises reading and storing continually over time intervals electrical operating variables of at least some supplementary elements of the cooling system chosen from the group consisting of a ventilator, heating resistors, a cooling fluid flow control valve, an air flow control regulator, a lamp inside the cooled space and a lamp outside the cooled space, by means of an electrical connection between the control circuit and at least some supplementary elements of the cooling system.

21. The control method according to claim 13, wherein the control method is applied to a control system as defined in claim 1.

* * * * *

UNITED STATES PATENT AND TRADEMARK OFFICE

CERTIFICATE OF CORRECTION

PATENT NO. : 8,417,387 B2
APPLICATION NO. : 12/302312
DATED : April 9, 2013
INVENTOR(S) : Neto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 701 days.

Signed and Sealed this
Eighth Day of April, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,417,387 B2
APPLICATION NO. : 12/302312
DATED : April 9, 2013
INVENTOR(S) : Neto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1,164 days.

Signed and Sealed this
Seventeenth Day of March, 2015

Michelle K. Lee

Michelle K. Lee
*Director of the United States Patent and Trademark Office*